US007819622B2

(12) United States Patent
Paulino et al.

(10) Patent No.: US 7,819,622 B2
(45) Date of Patent: Oct. 26, 2010

(54) METHOD FOR SECURING A STATOR ASSEMBLY

(75) Inventors: Jose Paulino, Saco, ME (US); Richard K. Hayford, Cape Neddick, ME (US)

(73) Assignee: United Technologies Corporation, Hartford, CT (US)

( * ) Notice: Subject to any disclaimer, the term of this patent is extended or adjusted under 35 U.S.C. 154(b) by 980 days.

(21) Appl. No.: 11/641,326

(22) Filed: Dec. 19, 2006

(65) Prior Publication Data

US 2008/0145217 A1 Jun. 19, 2008

(51) Int. Cl.
*F01D 9/04* (2006.01)

(52) U.S. Cl. ..... 415/104; 415/136; 415/137; 415/207; 415/209.2; 415/211.2

(58) Field of Classification Search ..... 415/104, 415/136, 137, 189–190, 207, 209.2, 209.3, 415/209.4, 210.1, 211.2
See application file for complete search history.

(56) References Cited

U.S. PATENT DOCUMENTS

| | | | | |
|---|---|---|---|---|
| 3,067,983 | A * | 12/1962 | Koziura | 415/209.2 |
| 6,517,313 | B2 * | 2/2003 | Rogers | 415/137 |
| 6,916,154 | B2 * | 7/2005 | Synnott | 415/209.2 |
| 7,121,791 | B2 | 10/2006 | Friedl et al. | |
| 7,300,246 | B2 * | 11/2007 | Durocher et al. | 415/209.3 |
| 7,329,096 | B2 * | 2/2008 | Tomko et al. | 415/209.4 |

* cited by examiner

*Primary Examiner*—Christopher Verdier
(74) *Attorney, Agent, or Firm*—Carlson, Gaskey & Olds

(57) ABSTRACT

An example exit guide vane for a gas turbine engine is mounted adjacent to a diffuser case defining an air flow path. A thrust balance seal is attached to the diffuser and the exit guide vane is mounted adjacent the diffuser case for guiding air flow into the air flow path. The exit guide vane is mounted adjacent to the diffuser without interfering with the air flow path or restricting thermal expansion.

21 Claims, 5 Drawing Sheets

METHOD FOR SECURING A STATOR ASSEMBLY

BACKGROUND OF THE INVENTION

This invention generally relates to an exit or outlet guide vane for a gas turbine engine. More particularly, this invention relates to a device and method for securing an exit guide vane in a gas turbine engine which permits the exit guide vane to expand thermally unconstrained.

A turbine engine includes an exit guide vane assembly to direct air into a diffuser assembly. The exit guide vane is typically secured to the diffuser assembly or a compressor case assembly with a bolted joint and may include radial or axial snaps. Pressure losses and localized flow heating is caused by the disruption of the flow caused by the bolted joint. Further, the bolted joint and snaps constrains the exit guide vane from expanding thermally. This restriction of thermal expansion can undesirably increase stresses on the exit guide vane and adjoining parts.

Accordingly, it is desirable to develop and design a mounting method and device for securing an exit guide vane which permits the exit guide vane to expand thermally unconstrained.

SUMMARY OF THE INVENTION

A disclosed example gas turbine engine includes an exit guide vane that is mounted adjacent to a diffuser assembly with connections that do not interfere with air flow or restrict thermal expansion.

The example exit guide vane is disposed forward of the diffuser assembly. A thrust balance seal is attached to the diffuser assembly through a plurality of bolted connections. The exit guide vane is held between the diffuser assembly and the thrust balance seal. No bolted connection is provided between the exit guide vane and the diffuser assembly. Further, the bolted connection between the diffuser assembly and the thrust balance seal is disposed outside of any primary or secondary air flows. Tabs of the exit guide vane are received within a corresponding slot of the diffuser assembly. The interface between the tabs and the slots secures the exit guide vane against rotation relative to the diffuser assembly.

Another example exit guide vane is mounted adjacent to a diffuser case and is held in place on a thrust balance seal. The thrust balance seal is bolted to the diffuser case outside of any primary or secondary air flows. The exit guide vane is secured to the thrust balance seal by a plurality of tabs that interfit into corresponding lugs on the thrust balance seal.

Accordingly, the example exit guide vane assembly is mounted adjacent to the diffuser case with a connection that does not interfere with any air flows, and that permits the exit guide vane to expand thermally unconstrained.

These and other features of the present invention can be best understood from the following specification and drawings, the following of which is a brief description.

DETAILED DESCRIPTION OF THE PREFERRED EMBODIMENT

Figure 1:
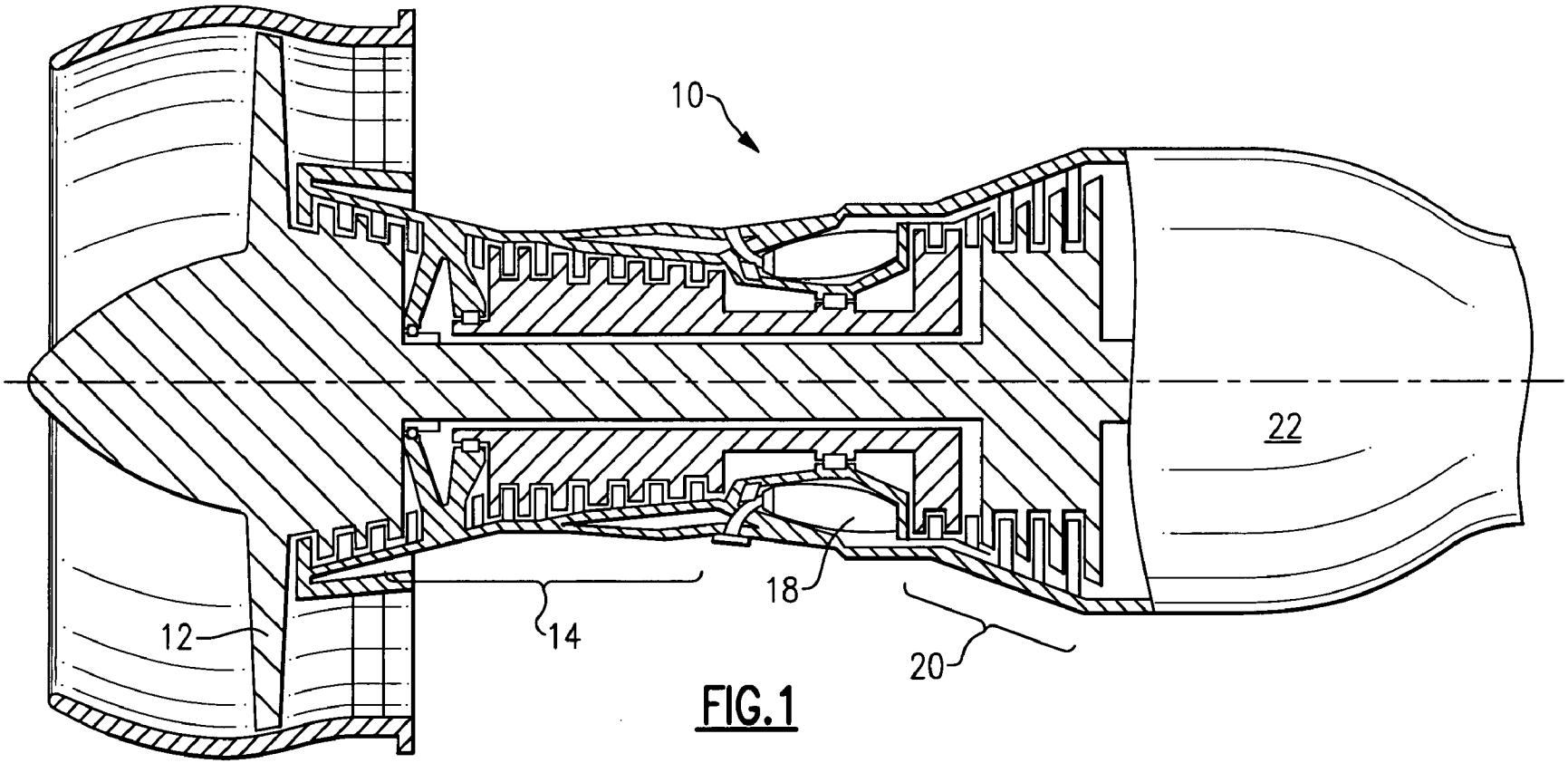
FIG. 1 is a schematic view of an example gas turbine engine.

Referring to FIG. 1, an example gas turbine engine 10 includes a fan 12, a compressor module 14 that compresses incoming air that is supplied to a combustor module 18. Exhaust gases generated in the combustor module 18 are exhausted through a turbine module 20 that in turn drives the compressor module 14. Exhaust gases are then directed through an exhaust nozzle assembly 22. Air from the compressor module 14 proceeds through an exit guide vane that removes any swirl from the air flow. Following the exit guide vane, the diffuser assembly (not shown) conditions the airflow by causing a decrease in velocity and an increase in pressure prior to entering the combustor module 18. The diffuser assembly can experience severe temperature fluctuations that can cause differing amounts of thermal growth within the same assembly.

Figure 2:
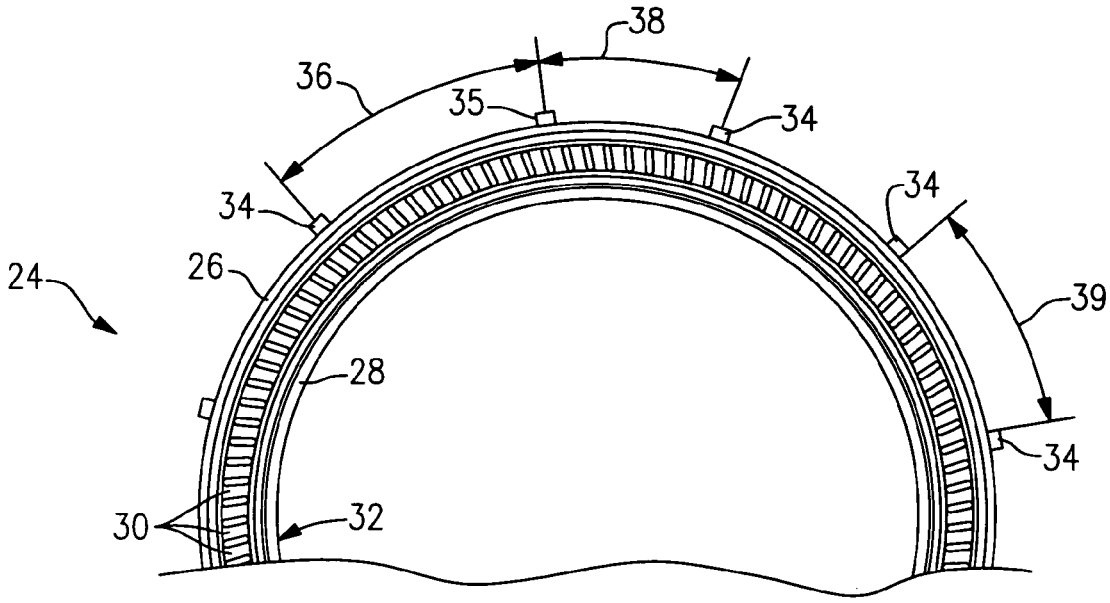
FIG. 2 is a front view of an example exit guide vane.

Referring to FIG. 2, prior to entering the diffuser assembly, air flow travels through an exit guide vane 24. The exit guide vane 24 is static and defines an air flow path from the last rotating compressor module element to the diffuser assembly. The example exit guide vane 24 includes an outer ring 26 spaced radially apart from an inner ring 28. A plurality of vanes 30 extends radially within the space between the inner ring 28 and the outer ring 26. The inner ring 28 includes an inner flange 32 that is utilized for mounting and securing the exit guide vane 24 axially. The outer ring 26 includes a plurality of tabs 34 spaced circumferentially apart a distance 39. The tabs 34 engage a mating element for securing the exit guide vane 24 against undesired rotation. The example exit guide vane 24 includes 12 tabs 34 that are spaced circumferential apart. The indexing tab 35 is spaced apart circumferentially a distance different than is provided between tabs 34. Except for an indexing tab 35' each of the tabs 34 are spaced an equal distance 39 apart. The indexing tab 35 is spaced a distance 36, and 38 from neighboring tabs 34 to provide a key that provides for a desired circumferential orientation between the exit guide vane 24 and the diffuser assembly 16. At least one of the plurality of tabs may be spaced circumferentially apart a distance different than the other plurality of tabs for defining a circumferential relationship between the exit guide vane and the diffuser case.

Figure 3:
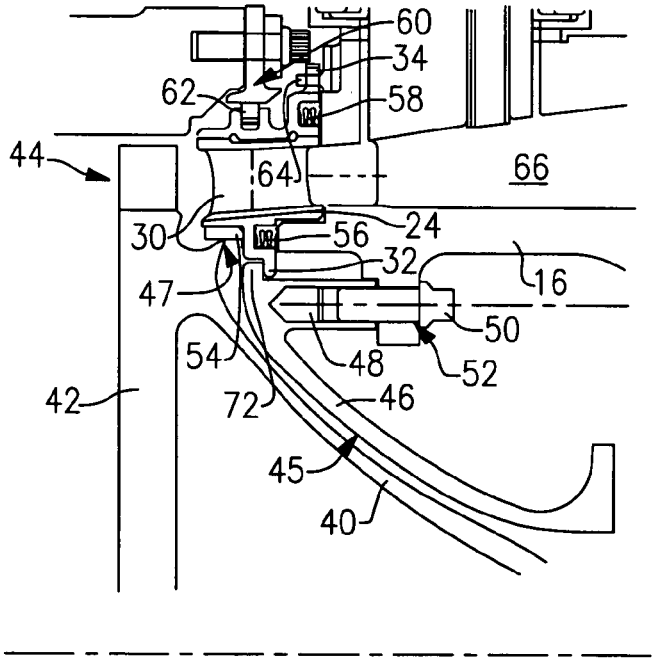
FIG. 3 is a cross-sectional view of an example exit guide vane mounted within an example gas turbine engine.

Referring to FIG. 3, the exit guide vane 24 is disposed forward of a diffuser assembly 16. A thrust balance seal 46 is attached to the diffuser assembly 16 through a plurality of bolted connections. One bolted connection is shown and includes a bolt 50 that extends through an opening 52 and is engaged within a threaded hole 48 of the thrust balance seal 46. The flange 32 of the exit guide vane 24 is held between the diffuser assembly 16 and a lip 72 of the thrust balance seal 46. No bolted connection, fastening member or snaps are provided between the exit guide vane 24 and the diffuser assembly 16. Further, the bolted connection between the diffuser assembly 16 and the thrust balance seal 46 is disposed outside of any primary or secondary air flows. For this reason, the bolted connection does not cause undesired disruptions in the air flow.

Figure 4:
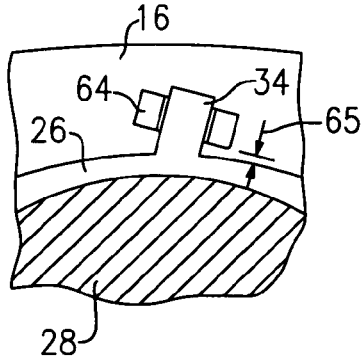
FIG. 4 is an enlarged front view of an example interface between a tab of the exit guide vane and a slot on a diffuser assembly.

Referring to FIG. 4 with continuing reference to FIG. 3, the tabs 34, of the exit guide vane 24 are received within a corresponding slot 64 of the diffuser assembly 16, one of which is shown in FIG. 4. The interface between the tabs 34 and the slots 64 secures the exit guide vane 24 against rotation relative to the diffuser assembly 16. The slot 64 is spaced radially apart a distance 65 from the outer ring 26 to provide space for relative radial movement between the diffuser assembly 16 and the exit guide vane 24 caused by, for example thermal expansion.

Referring to FIG. 3, a rotor 42 includes a plurality of air foils 44 that rotates relative to the static exit guide vane 24 and thrust balance seal 46. An aft rotor hub 40 includes a knife edge 47 that abuts a seal 54 that is supported on an inner diameter of the exit guide vane 24.

The exit guide vane 24 abuts the diffuser assembly 16 radially inward and outward of an air flow path 66. The radially inward and outward contact between the exit guide vane 24 and the diffuser assembly 16 are leakage paths that are sealed by an outer seal 58 and an inner seal 56. The outer and inner seals 58, 56 are disposed within corresponding annular cavities of the exit guide vane 24. The outer and inner seals 58 and 56 are biased outwardly against the surface of the diffuser assembly 16. The example seals 58, 56 include a "W" shape, however other seal configuration as are known are within the contemplation for use with the example exit guide vane 24.

The exit guide vane 24 also includes a piston ring seal 62 that cooperates with a seal land on the compressor case 60. The piston ring seal 62 is disposed about an outer circumference of the exit guide vane 24 and is biased radially outward to provide the desired seal and constraint of air flow.

Figure 5:
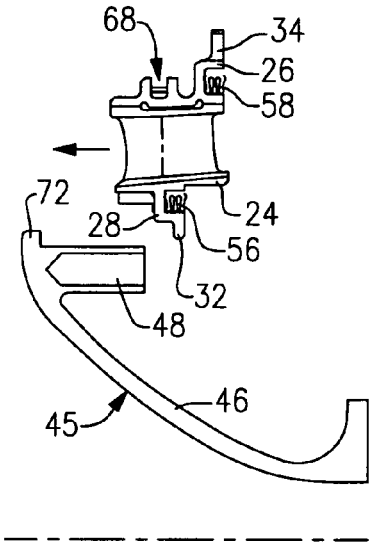
FIG. 5 is a cross-section of an example exit guide vane prior to assembly to a thrust balance seal.

Referring to FIG. 5, assembly of the exit guide vane 24 to the diffuser assembly 16 includes the initial step of inserting the thrust balance seal 46 within the inner diameter of the exit guide vane 24. The thrust balance seal 46 is received within the inner diameter of the exit guide vane 24 such that the lip 72 abuts the inner diameter flange 32. The outer seal 58 and the inner seal 56 are installed within corresponding annular pockets to complete the initial subassembly of the exit guide vane 24.

Figure 6:
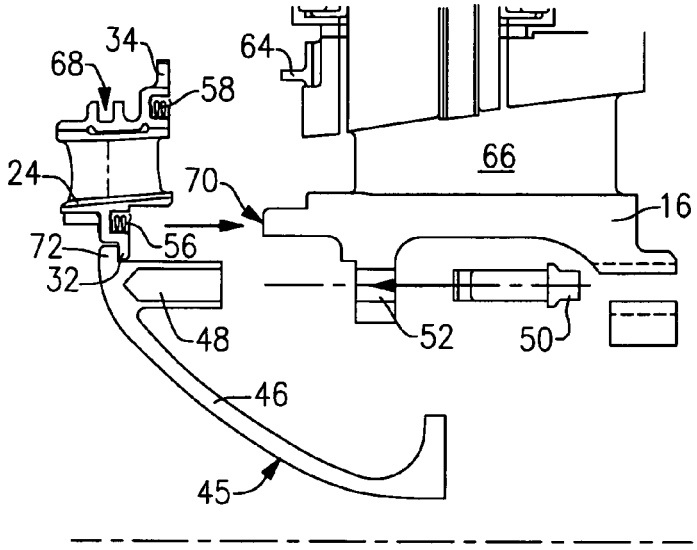
FIG. 6 is a cross-section of an example exit guide vane and thrust balance seal being mounted to a diffuser case.

Referring to FIG. 6, the thrust balance seal 46 is bolted to the diffuser assembly 16. The diffuser assembly 16 includes an opening 52 for a bolt 50. The bolt 50 is threaded into the threaded opening 48 within the thrust balance seal 46. The example position of the bolted connection is illustrated substantially adjacent an outer portion of the diffuser assembly 16. Other positions of the bolted connection that ease assembly are also possible. The bolted connection is however always disposed on a back or non-airflow side of the thrust balance seal 46.

Securement of the thrust balance seal 46 to the diffuser assembly 16 traps the flange 32 of the exit guide vane 24 between the lip 72 of the thrust balance seal 46 and the forward surface 70 of the diffuser assembly 16. The flange 32 is held in place between the diffuser assembly 16 and the thrust balance seal 46 and constrains forward axial movement of the exit guide vane 24. Circumferential movement of the exit guide vane 24 is constrained by the interface between the tabs 34 and the corresponding slots 64 on the diffuser assembly 16. The slots 64 are spaced radially outboard from the outer ring 26 of the exit guide vane 24 to provide room to accommodate any relative expansion between the diffuser assembly 16 and the exit guide vane 24.

Figure 7:
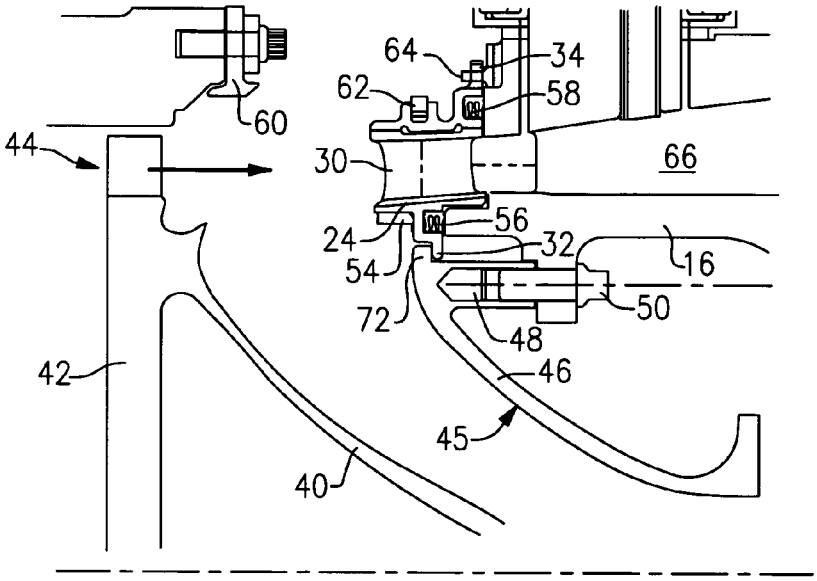
FIG. 7 is a cross-sectional view of the example exit guide vane mounted to the diffuser.

Referring to FIG. 7, with the exit guide vane 24 and the thrust balance seal 46 secured to the diffuser assembly 16, the rotor 42 and aft rotor hub 40 can be assembled as required to engage and seal against the surfaces of the exit guide vane 24 and the thrust balance seal 46. The piston ring seal land 60 seals against the piston ring 62 disposed within an annular groove on the outer circumferences of the exit guide vane 24.

The interface between the rotor 42 the thrust balance seal 46 and the exit guide vane 24 include no bolted connections that are disposed within an air flow path. Seals are provided to minimize leakage or calibrate air flow as is desired. The outer and inner seals 58 and 56 substantially prevent air flow leakage or air flow recirculation such that air flows through the air flow path 66 defined by the diffuser assembly.

The seal 54 provides a calibrated leakage of air flow along the forward surface 45 of the thrust balance seal 46. However, no mounting connection is disposed along the forward surface 45 that could disrupt the desired air flow.

Figure 8:
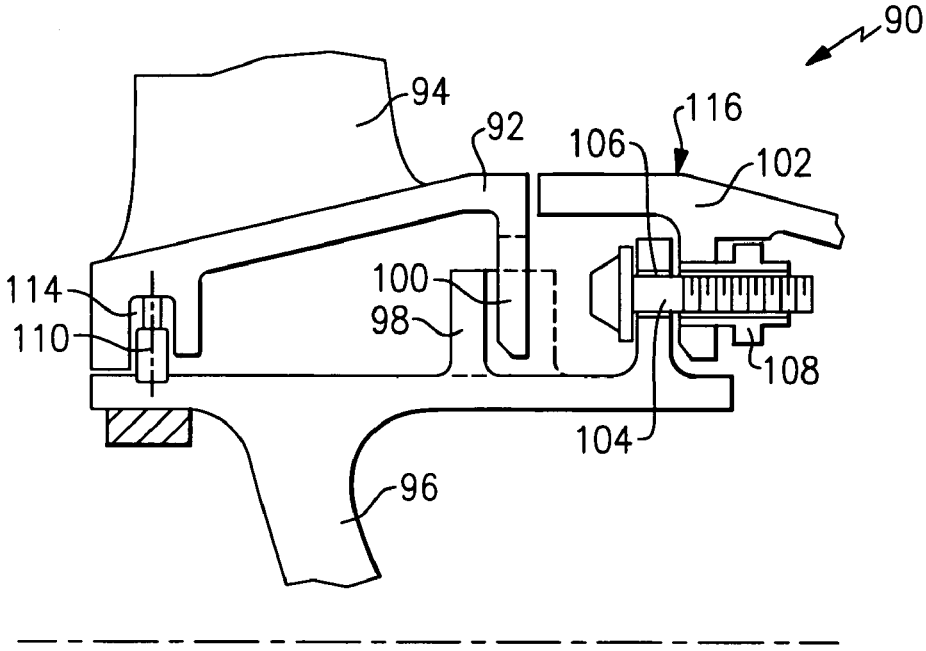
FIG. 8 is a cross-sectional view of another example exit guide vane mounted to an example diffuser case.

Referring to FIG. 8, another example exit guide vane 92 is mounted adjacent to a diffuser case 102 and is held in place by a thrust balance seal 96. The thrust balance seal 96 is attached to the diffuser case 102 by a bolted connection including a bolt 104 extending through an opening 106 in the thrust balance seal 96 and engaged to threaded opening 108 within the diffuser case 102. Although a bolt is disclosed, other fasteners as are known could also be utilized.

In this example, the thrust balance seal 96 is secured to the diffuser case 102 before the exit guide vane 92. The exit guide vane 92 is then assembled onto the thrust balance seal 96. The exit guide vane 92 is secured to the thrust balance seal 96 by a plurality of tabs 100 that interfit into corresponding lugs 98. The exit guide vane 92 includes the tabs 100 and the thrust balance seal includes the lugs 98. A seal 110 is disposed within a pocket 114 of the exit guide vane 92 that contacts an outer surface of the thrust balance seal 96. Air flows over and through vanes 94 and into the diffuser case 102 along a surface 116. The bolted connection between the thrust balance seal 96 and the diffuser case 102 is disposed below the surface 116 so as to not interfere with air flow.

Figure 9:
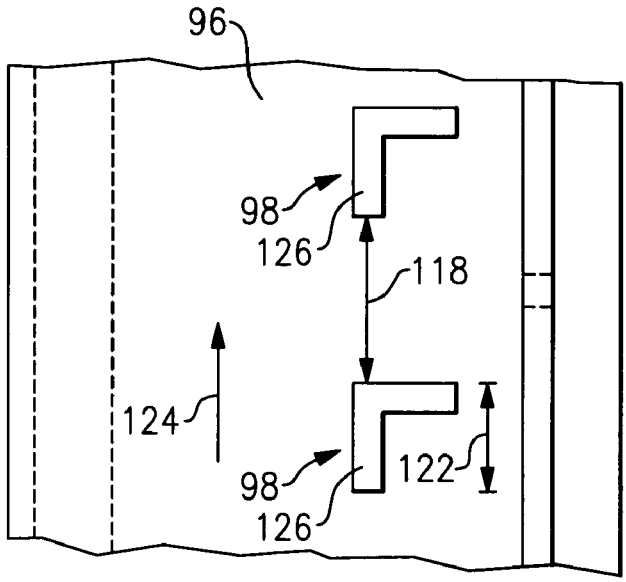
FIG. 9 is a top view of a portion of the example diffuser case.
Figure 10:
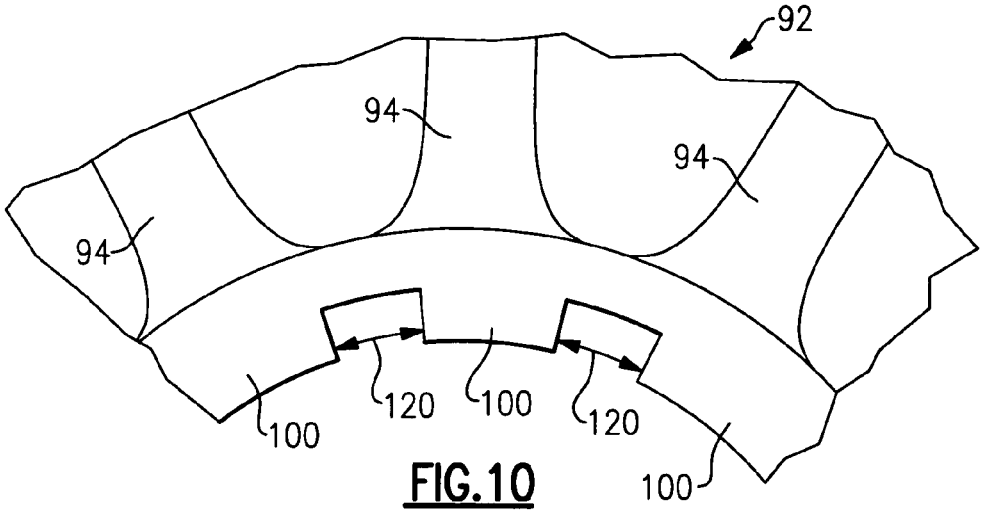
FIG. 10 is a front view of a portion of the example exit guide vane.

Referring to FIGS. 9 and 10 with continued reference to FIG. 8, the lugs 98 are "L" shaped and are spaced circumferentially a distance 118. The example exit guide vane 92 include the tabs 100 that are spaced apart a distance 120. The distance 120 corresponds with a circumferential length 122 of the lugs 98. Assembly of the exit guide vane 92 includes sliding the exit guide vane 92 over the thrust balance seal 96 such that the lugs 98 slide through the space between the tabs 100. Once the exit guide vane 92 is disposed against the diffuser case 102, it is rotated so that the tabs 100 are received aft of the front portion 126 of each corresponding lug 98. Once the tabs 100 are interlocked with the corresponding lug 98, movement is constrained in a first circumferential direction and the forward axial direction.

Figure 11:
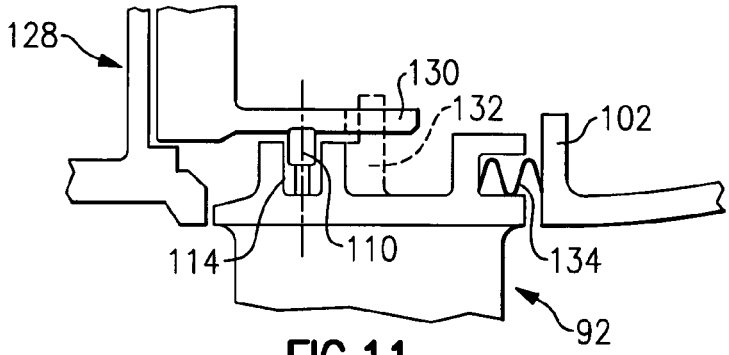
FIG. 11 is a cross-sectional view of an example interface between a stator case and the example exit guide vane.
Figure 12:
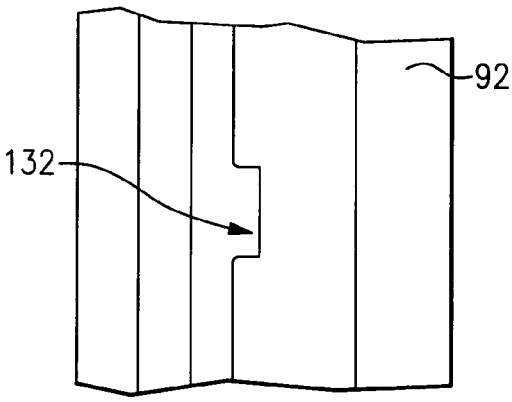
FIG. 12 is a front view of a slot in the example exit guide vane.
Figure 13:
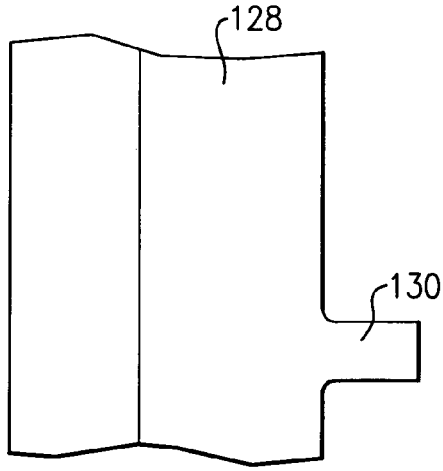
FIG. 13 is a front view of a lug in the example stator case.

Referring to FIGS. 11, 12 and 13, a high pressure compressor stator case 128 includes a lug 130 that is received within a slot 132 of the exit guide vane 92. The lug 130 prevents rotation of the exit guide vane 92 in a second circumferential direction opposite from the first circumferential direction. The lug 130, slot 132 interface in combination with the tab 100 and lug 98 interface between the thrust balance seal 96 and the exit guide vane 92 prevent rotation. The exit guide vane 92 is, however, free to expand and contract radially relative to the diffuser case 102, thrust balance seal 96 and the stator case 128. This interface and securement configuration accommodates radial thermal expansion and displacement that can occur during operation.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An exit guide vane mounting assembly comprising:

a diffuser case defining an air flow path;

a thrust balance seal attached to the diffuser case; and an exit guide vane mounted adjacent to the diffuser case for guiding air flow into the air flow path, wherein the exit guide vane is secured adjacent to the diffuser case without a fastener.

2. The assembly as recited in claim 1, wherein the thrust balance seal is secured to the diffuser case with a fastener that is disposed outside of the air flow path.

3. The assembly as recited in claim 2, wherein the diffuser case includes a surface defining a flow surface of the air flow path and the fastener is disposed on a side opposite the flow surface.

4. The assembly as recited in claim 1, wherein the exit guide vane is held in place between a portion of the thrust balance seal and the diffuser case.

5. The assembly as recited in claim 1, including an anti-rotation feature disposed on one of the diffuser case and thrust balance seal for preventing rotation of the exit guide vane relative to the diffuser case.

6. The assembly as recited in claim 5, wherein the anti-rotation feature comprises a slot disposed on one of the thrust balance seal and the diffuser case that is engageable with a tab disposed on the exit guide vane.

7. An exit guide vane mounting assembly comprising:

a diffuser case including a plurality of slots spaced circumferentially about an axis;

a thrust balance seal mountable to the diffuser case; and an exit guide vane assembly mounted against the diffuser case and held in place by the thrust balance seal, where the exit guide vane includes a plurality of tabs engageable with the plurality of slots on the diffuser case for inhibiting rotation of the exit guide vane relative to the diffuser case.

8. The assembly as recited in claim 7, wherein the exit guide vane includes an inner flange secured between the thrust balance seal and the diffuser case.

9. The assembly as recited in claim 7, wherein the plurality of tabs extend from an outer perimeter of the exit guide vane.

10. The assembly as recited in claim 9, wherein each of the plurality of tabs fits into a corresponding one of the plurality of slots on the diffuser case.

11. The assembly as recited in claim 10, wherein at least one of the plurality of tabs is spaced circumferentially apart a distance different than the other plurality of tabs for defining a circumferential relationship between the exit guide vane and the diffuser case.

12. The assembly as recited in claim 7, wherein the thrust balance seal includes a threaded opening disposed on a back side not exposed to incoming flow for receiving a fastener for mounting the thrust balance seal to the diffuser case.

13. The assembly as recited in claim 7, including an inner seal and an outer seal between the exit guide vane.

14. The assembly as recited in claim 13, wherein the inner seal and the outer seal bias the exit guide vane in a direction away from the diffuser case.

15. The assembly as recited in claim 7, wherein the exit guide vane includes an inner ring and an outer ring spaced radially apart from the inner ring and a plurality of vanes extending radially between the inner ring and the outer ring.

16. The assembly as recited in claim 15, including a ring seal disposed on the outer ring of the exit guide vane.

17. The assembly as recited in claim 15, including a seal disposed on the inner ring for sealing with a rotating member.

18. An exit guide vane mounting assembly comprising:

an exit guide vane including an outer rim spaced radially apart from an inner rim and a plurality of vanes extending radially from the inner rim to the outer rim;

a thrust balance seal secured to a diffuser case, wherein the thrust balance seal includes a plurality of lugs; and a plurality of tabs disposed on the inner rim that are engageable with the plurality of lugs on the thrust balance seal for securing the exit guide vane against the diffuser case.

19. The assembly as recited in claim 18, wherein the tabs of the exit guide vane are rotated to engage the lugs on the thrust balance seal.

20. The assembly as recited in claim 18, wherein the exit guide vane includes a slot and a stator case includes an extension received within the slot for securing the exit guide vane from movement in a circumferential direction.

21. The assembly as recited in claim 18, wherein the thrust balance seal is attached to the diffuser case by a fastener that is disposed on a side of the diffuser case that does not define a surface of an air flow path.

* * * * *